US007079107B2

(12) United States Patent
Miyake

(10) Patent No.: US 7,079,107 B2
(45) Date of Patent: Jul. 18, 2006

(54) LIQUID CRYSTAL DISPLAY DEVICE

(75) Inventor: Shiro Miyake, Kumamoto (JP)

(73) Assignee: Advanced Display, Inc., Kumamoto (JP)

( * ) Notice: Subject to any disclaimer, the term of this patent is extended or adjusted under 35 U.S.C. 154(b) by 153 days.

(21) Appl. No.: 10/300,045

(22) Filed: Nov. 19, 2002

(65) Prior Publication Data

US 2003/0117364 A1 Jun. 26, 2003

(30) Foreign Application Priority Data

Dec. 25, 2001 (JP) ..... 2001-392029

(51) Int. Cl.
*G09G 3/36* (2006.01)

(52) U.S. Cl. ..... 345/102; 345/76; 345/77; 345/82; 345/83; 345/87; 345/88

(58) Field of Classification Search ..... 345/76–77, 345/82–83, 87–88, 99, 102, 204, 207
See application file for complete search history.

(56) References Cited

U.S. PATENT DOCUMENTS

| | | | | |
|---|---|---|---|---|
| 5,216,287 | A * | 6/1993 | Tigges et al. | 307/116 |
| 6,650,822 | B1 * | 11/2003 | Zhou | 385/147 |
| 6,677,936 | B1 * | 1/2004 | Jacobsen et al. | 345/211 |
| 2004/0140972 | A1 * | 7/2004 | Hirota et al. | 345/204 |

FOREIGN PATENT DOCUMENTS

| | | |
|---|---|---|
| JP | 5-40260 | 2/1993 |

OTHER PUBLICATIONS

Patent Abstracts of Japan, English abstract of app. # 03-197 567 of Aug. 7, 1991, UENO/NEC, publ. Feb. 19, 1993 as unexamined application publ. # JP 05-040 260.

* cited by examiner

*Primary Examiner*—Bipin Shalwala
*Assistant Examiner*—Leonid Shapiro

(57) ABSTRACT

A liquid crystal display device for color display comprising a transmission-type liquid crystal panel, capable of controlling an amount of transmission light, and a backlight disposed behind the liquid crystal panel capable of emitting three colors of light separately in a time-dividing manner, in which three data corresponding to the three colors of the backlight are displayed sequentially to thereby make the backlight emit a corresponding color in a period corresponding to data to be displayed. The switching can be performed manually or in response to outside signal, between a sequence in which the backlight emits three colors separately one time in one display period to perform color display, and a sequence in which the backlight emits three colors simultaneously three times to perform black-and-white display. The backlight emission can be switched, depending on the intensity of ambient light, thereby allowing switching between color display with low intensity and black-and-white display with high intensity.

6 Claims, 8 Drawing Sheets

LIQUID CRYSTAL DISPLAY DEVICE

BACKGROUND OF THE INVENTION

The present invention relates to a liquid crystal display device, and more specifically, to improvements in visibility of a liquid crystal display device with a backlight for flashing the three primary colors of light: red, green and blue.

As a display device for displaying color images, there has been used a liquid crystal display device in which color display is generally performed by the combination of liquid crystal for switching light and a color filter containing the three primary colors of light: R, G, B. On the other hand, a liquid crystal display device with the three primary color sequential lighting system, which has a backlight for flashing the three primary colors of light: R, G, B and does not have any color filter, has been proposed in Japanese Unexamined Patent Publication No. 40260/1993. An example of structure of the liquid crystal display device with the three primary color sequential lighting system is shown in FIG. 9. The device is composed of a black-and-white liquid crystal display device without any color filter and a backlight which can emit the three primary colors of light: R, G, B independently. The timing chart indicating the operational principle of this liquid crystal display device is shown in FIG. 8. In FIG. 8, one display period indicates an update period of data to be displayed, and is usually set at 16.7 ms in ordinary liquid crystal display devices because the length of time does not make the human eye detect flicker. The backlight flashes light of e.g. red, green, and blue in this order, only one time for each color during one display period, and when one of these colors is exclusively displayed, the liquid crystal device is ON during the emission of the light source for the color, and becomes OFF during the display periods assigned to the other colors, thereby performing color display.

The display period for each color is generally set at 5.6 ms, which is ⅓ of 16.7 ms. In order to display a color other than the three primary colors, the liquid crystal device is made ON only during the periods for the colors necessary to reproduce the color. Making the liquid crystal device produce halftones which are between ON and OFF allows the three primary colors of light to be mixed in a desired ratio, thereby reproducing any desired color. In this display system, three different data for red, green, and blue are required to be displayed within a single display period. This causes an increase in display frequency; however, a color filter becomes unnecessary and color display is performed by a single pixel, which is advantageous to achieve higher precision in the display device.

In the conventional primary color sequential lighting system, the backlight for each color flashes light sequentially in a time-dividing manner. This makes the luminance of the backlight lower than those of the constant lighting type, which might cause problems on luminance in some uses. For example, when a liquid crystal display device with the three primary color sequential lighting system is used outdoors, the display might become illegible if ambient light such as sunshine is stronger than the backlight. There are other cases where the display does not produce desired light and shade when the liquid crystal becomes slow in response rate due to low temperatures.

SUMMARY OF THE INVENTION

An object of the present invention is to provide a liquid crystal display device in which the content of display can be recognized even when ambient light is strong or when the liquid crystal becomes slow in response rate, by selecting the timing of backlight emission and selecting between the presence and absence of amendment of liquid crystal display data in the three primary color sequential lighting system.

In the liquid crystal display device with the three primary color sequential lighting system of the present invention, a first means improves visibility, i.e. legibility, by providing a circuit for emitting the three primary colors of light concurrently, i.e. simultaneously, when ambient light is strong, thereby making the device operate as a black-and-white display liquid crystal device with high luminance, and by allowing the circuit to switch between the three primary color sequential lighting and the three primary color concurrent or simultaneous lighting.

A second means automatically compensates the visibility, i.e. improves legibility, under strong ambient light by automatically switching from the three primary color sequential lighting to the three primary color concurrent lighting when the ambient light around the liquid crystal display device becomes strong, based on signals sent from an optical sensor built in the liquid crystal display device or installed outside the liquid crystal display device.

A third means improves visibility by converting color data to be displayed into black-and-white data to delay the display period and making the backlight emit the three primary colors of light concurrently when the liquid crystal becomes slow in response rate due to low temperatures or other reasons in a liquid crystal display device of the three primary color sequential lighting system.

DETAILED DESCRIPTION

Embodiment 1

Figure 1:
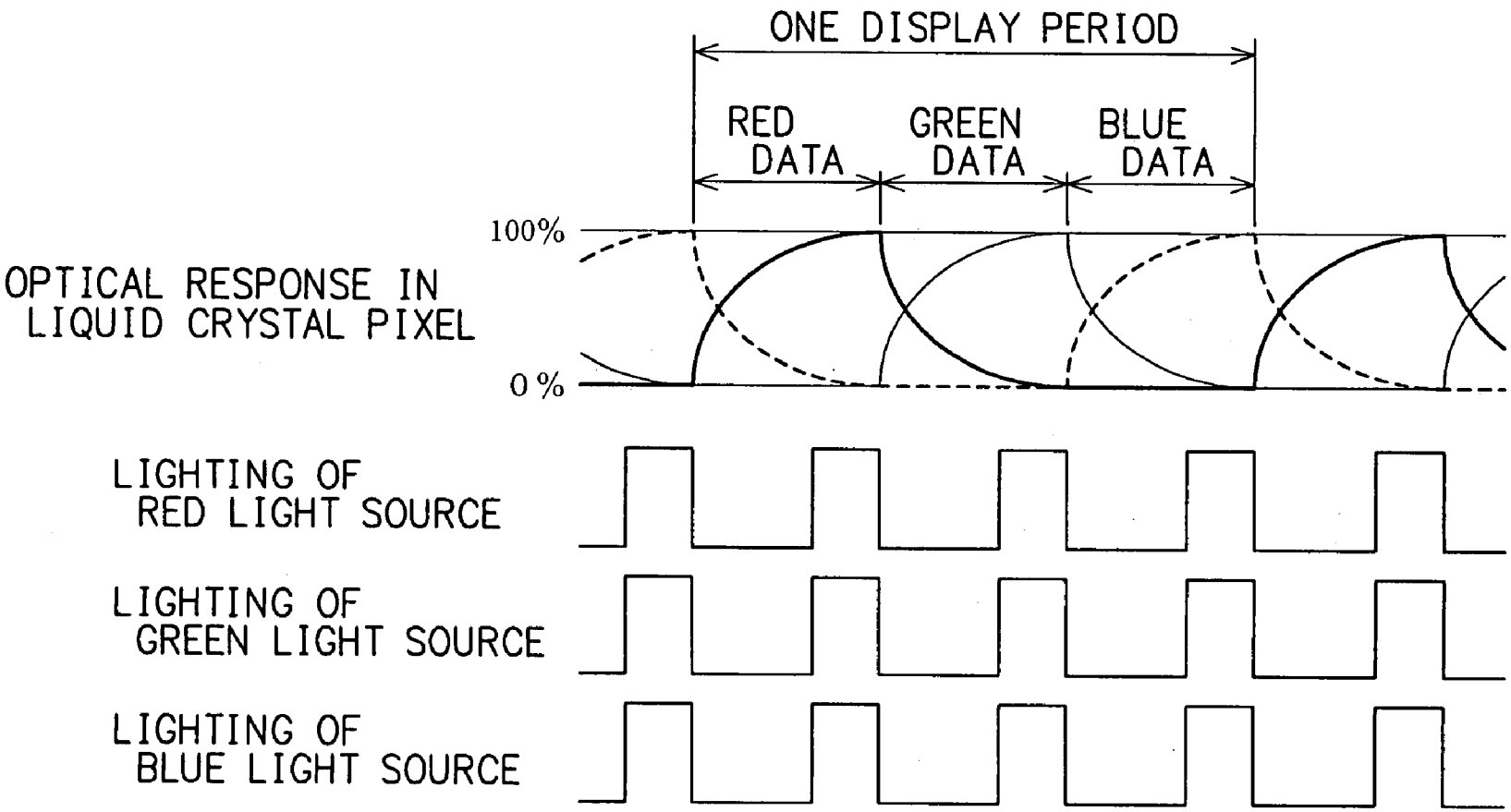
FIG. 1 is a timing chart showing operations of a liquid crystal display device according to an embodiment of the present invention.
Figure 2:
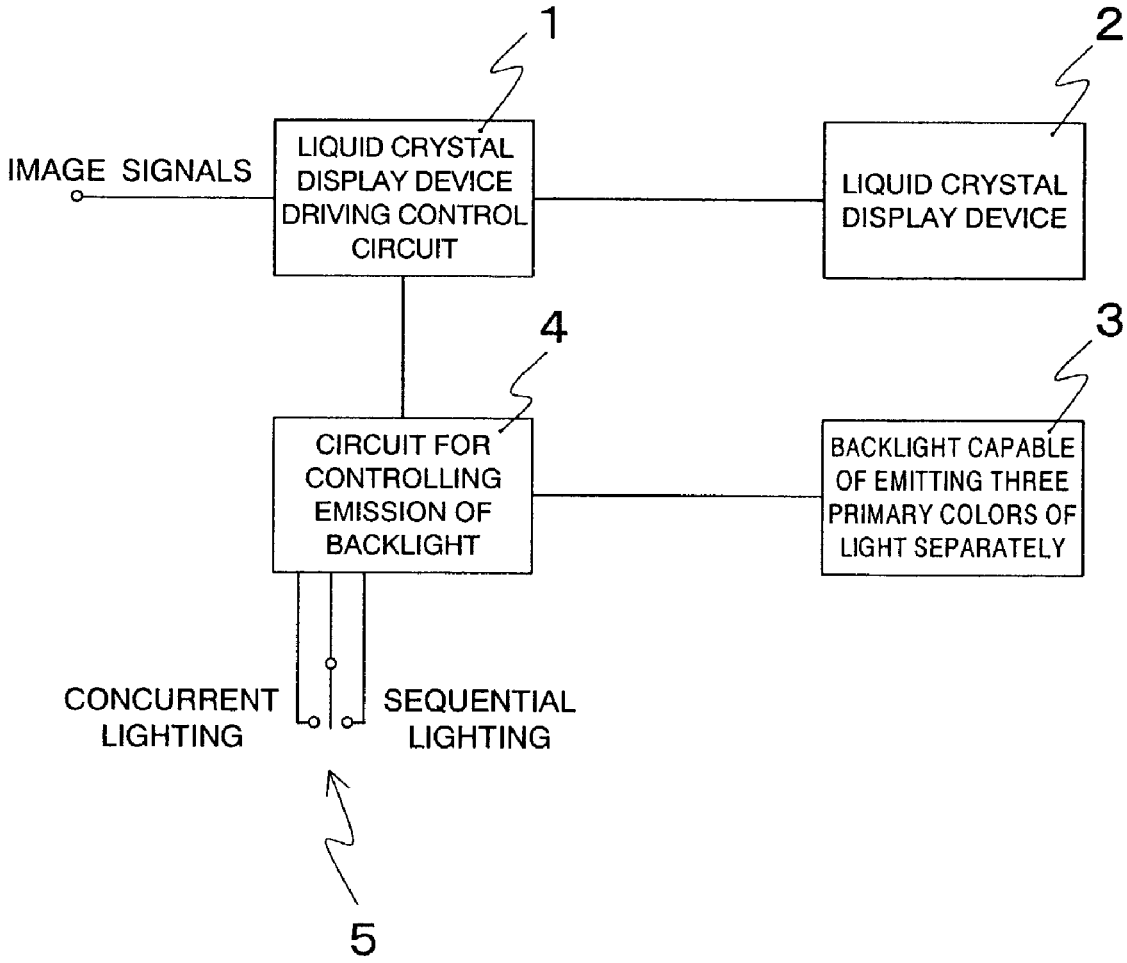
FIG. 2 is a block diagram showing the structure of the liquid crystal display device according to an embodiment of the present invention.
Figure 8:
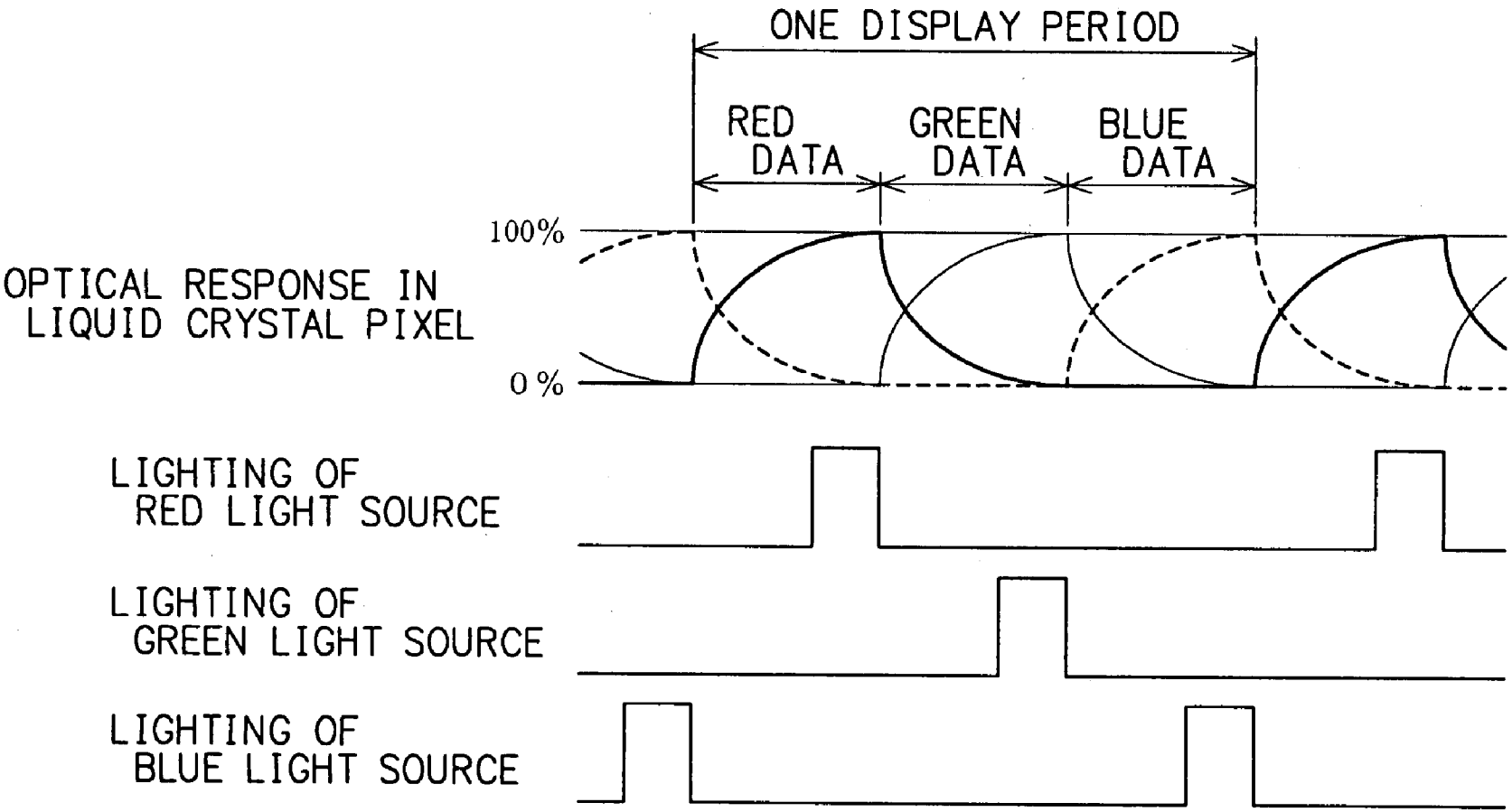
FIG. 8 is a timing chart showing operations of the conventional liquid crystal display device with the three primary color sequential lighting system.
Figure 9:
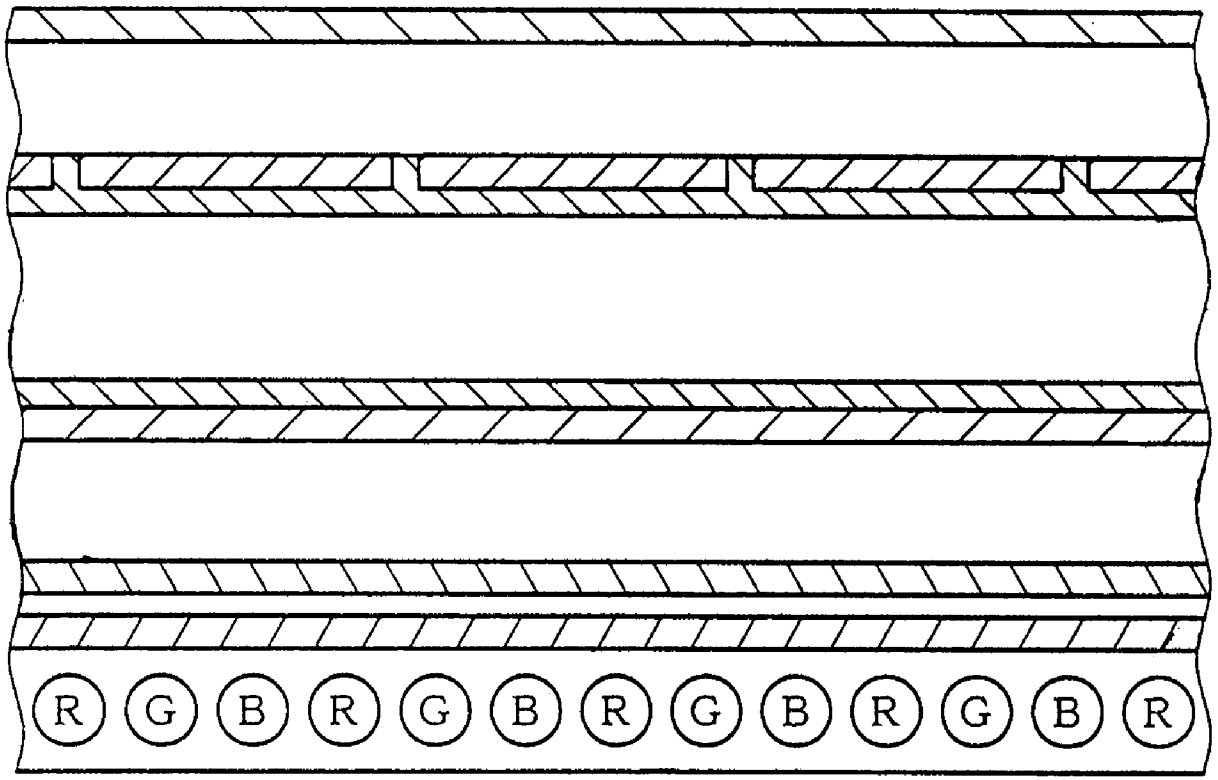
FIG. 9 is a cross sectional view showing the structure of the liquid crystal display device with the three primary color sequential lighting system.

Operations of a liquid crystal display device of the present invention will be described hereinbelow with reference to the drawings. FIG. 1 is a timing chart showing optical response in the liquid crystal pixels and the timing of backlight emission in the liquid crystal display device of the present invention while the three primary colors of light are emitted concurrently, i.e. simultaneously. FIG. 2 is a block diagram showing the outline of a circuit of the liquid crystal display device of the present invention. In FIG. 2, reference numeral 1 denotes a liquid crystal display device driving control circuit; 2 denotes a liquid crystal display device of black-and-white display without any color filter; 3 denotes a backlight capable of emitting the three primary colors of light separately; 4 denotes a circuit for controlling the emission of the backlight; 5 denotes a switch for switching the timing of emitting the backlight. The switch 5 allows switching between the ordinary three primary color sequential lighting system shown in FIG. 8 and the three primary color concurrent lighting system shown in FIG. 1. In FIG. 1, one display period indicates a period to switch screens to be displayed. During this display period, data for red, data for green, and data for blue are displayed one time each and, the backlight emits the three primary colors of light: R, G, B concurrently in the display period of any color. Such concurrent emission of the three primary colors of light causes the colors to be mixed and to be displayed in black and white; however, three times the luminance can be obtained, as compared with the luminance obtained using the ordinary three primary color sequential lighting system, thereby producing a display visible enough in a bright environment.

Embodiment 2

Figure 3:
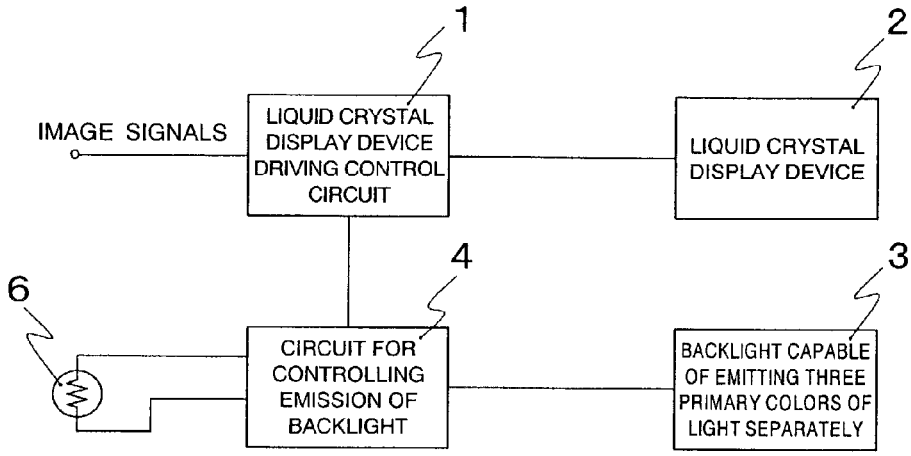
FIG. 3 is a block diagram showing the structure of the liquid crystal display device according to another embodiment of the present invention.

Another embodiment of the present invention will be shown in FIG. 3. In FIG. 3, reference numeral 6 denotes an optical sensor for detecting brightness. The switch 5 shown in FIG. 1 allows switching between the three primary color sequential lighting and the three primary color concurrent lighting in Embodiment 1; however, in the present invention, the optical sensor for detecting brightness provided in place of the switch allows automatic switching between the three primary color sequential lighting and the three primary color concurrent lighting, depending on the intensity of ambient light.

Figure 4:
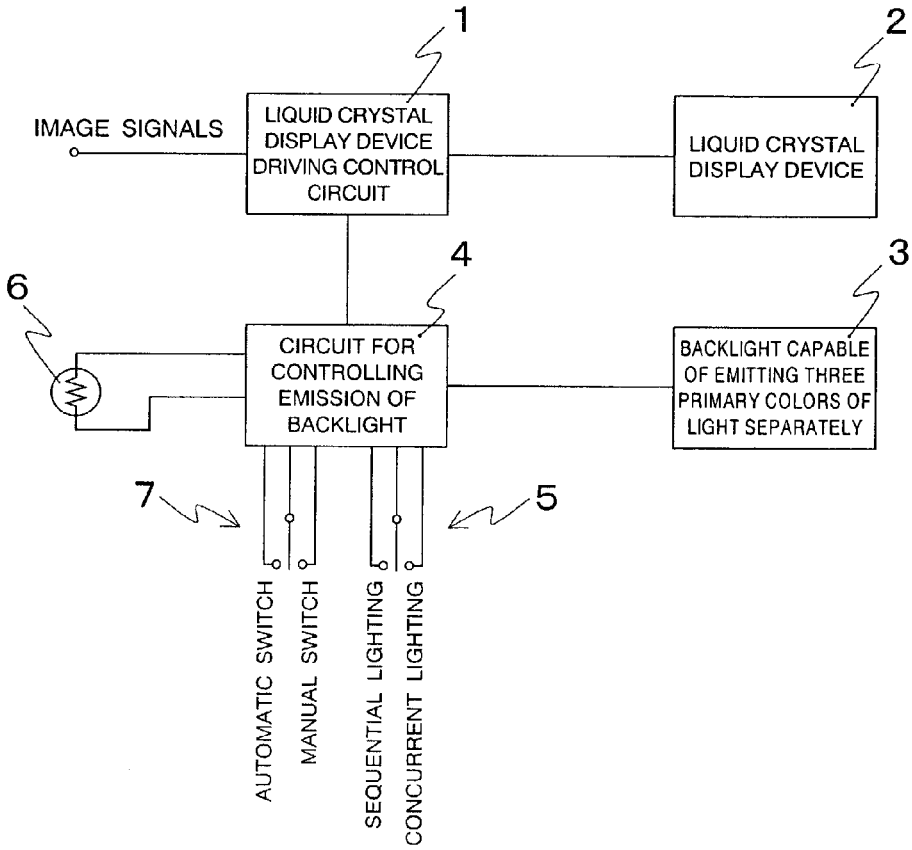
FIG. 4 is a block diagram showing the structure of the liquid crystal display device according to further another embodiment of the present invention.

As shown in FIG. 4, the provision of switches 5 and 7 makes it possible to switch between the lighting systems either automatically or manually. When the switch 7 is operated manually, a display is done in accordance with the switching between the sequential/concurrent lighting of the switch 5, whereas when the switch 7 operates automatically, the switching of the switch 5 is ignored and a display is switched by the optical sensor 5. Although FIGS. 2 and 4 show mechanical switches, when the backlight emission control circuit is controlled by another control device in terms of software, it can be controlled by a program.

Embodiment 3

Figure 5:
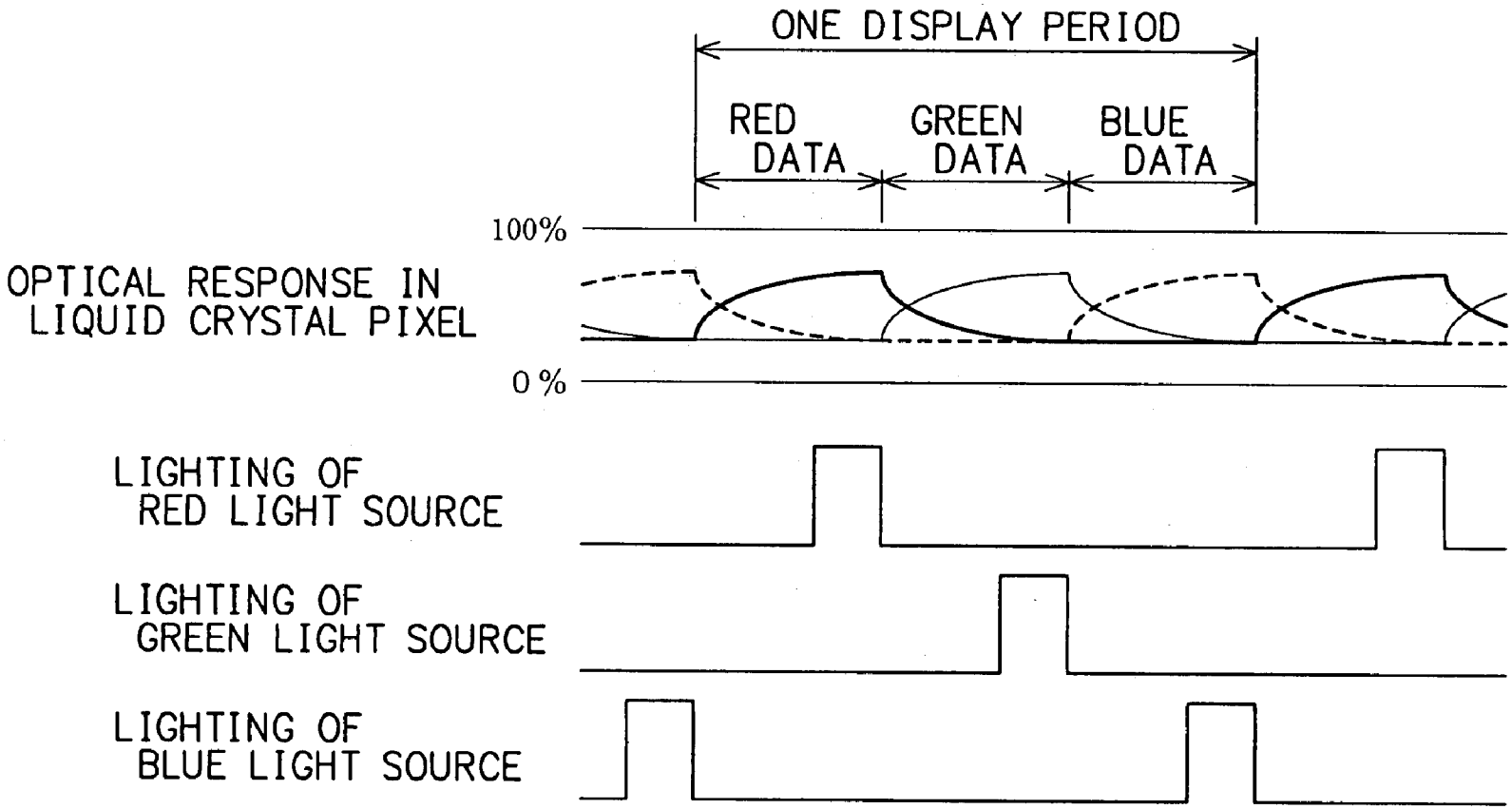
FIG. 5 is a timing chart showing operations of the conventional liquid crystal display device when the liquid crystal is slow in response rate.
Figure 6:
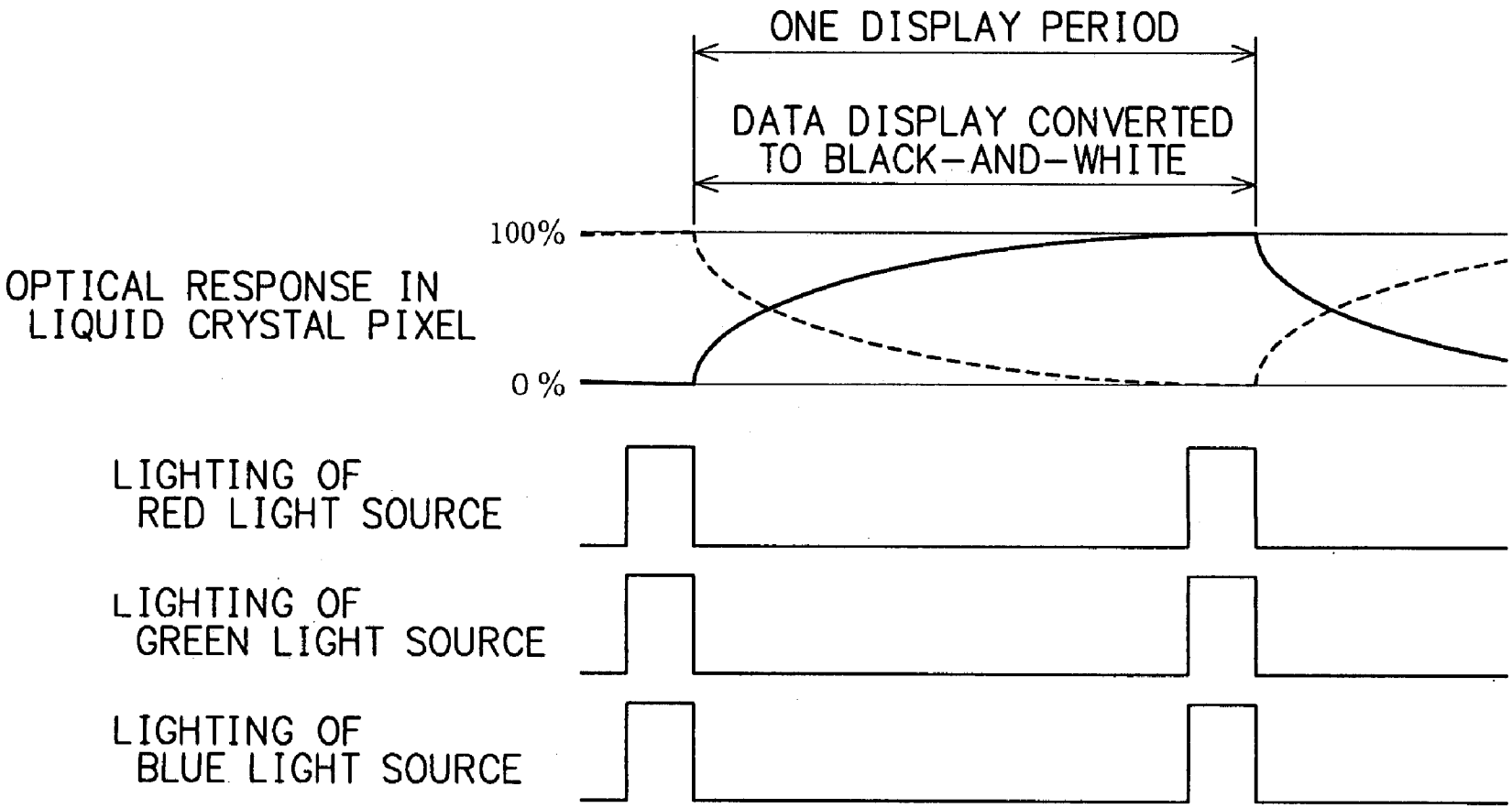
FIG. 6 is a timing chart showing operations of the liquid crystal display device according to another embodiment of the present invention.
Figure 7:
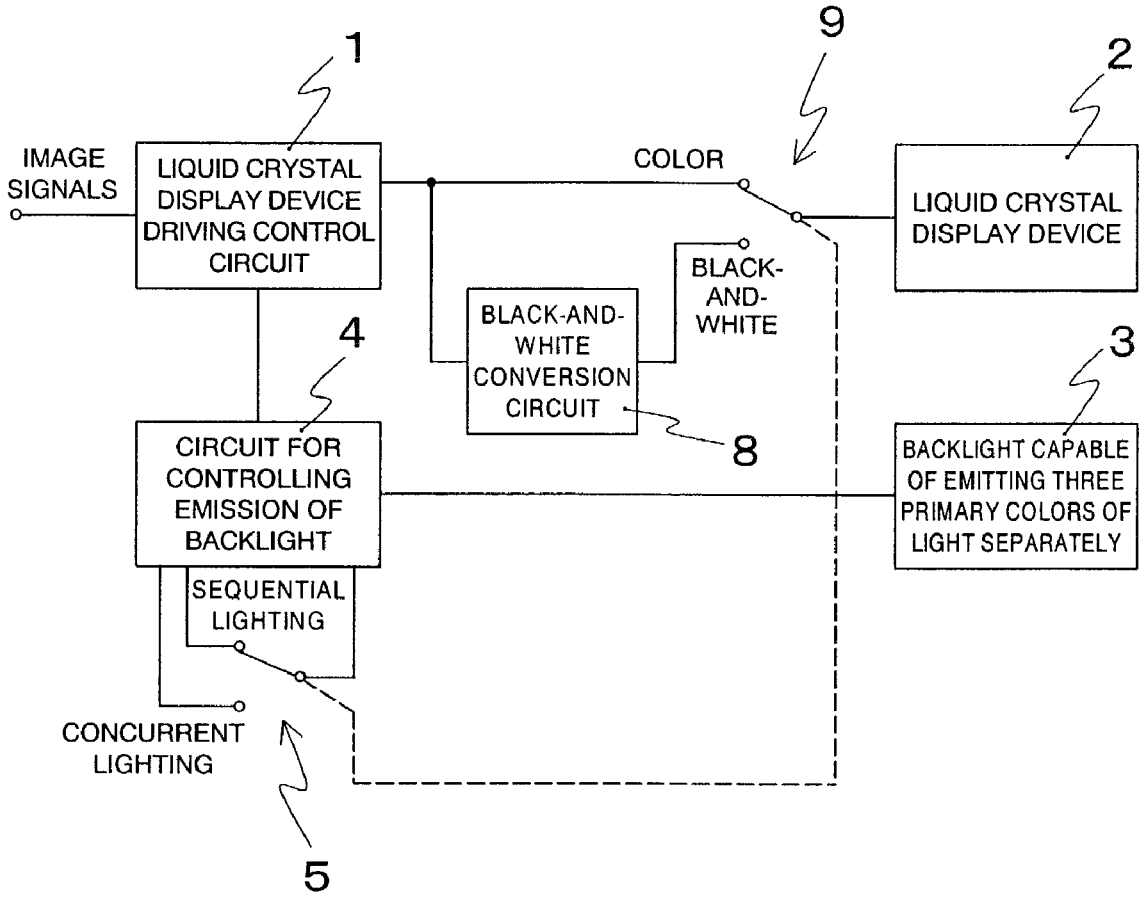
FIG. 7 is a block diagram showing the structure of the liquid crystal display device according to another embodiment of the present invention.

Another embodiment of the present invention will be described hereinbelow based on FIGS. 5 to 7. FIG. 5 shows a timing chart showing the case where the liquid crystal becomes slow in its response rate as the result of the fact that the liquid crystal display device becomes low in temperature in the conventional liquid crystal display device with the three primary color sequential lighting system. Since the response of the liquid crystal fails to follow within the display period of each color, contrast deteriorates, to thereby make it impossible to provide a display with the desired light and shade properties. In this case, because of the insufficient response of the liquid crystal, even if a black-and-white display is obtained by using the concurrent emission of the three primary colors of Embodiment 1, the luminance is improved but the ratio of light and shade of the display is not improved. In such a case, the respective data for R, G, B are averaged at the same timing to be converted into black-and-white display data and the backlight for the three primary colors of light are simultaneously emitted in the latter part of the display period, thereby improving the visibility of light and shade on display. FIG. 6 shows the timing chart in the case where the visibility has been improved. In FIG. 6, data for the three primary colors are displayed as black-and-white data, so that data to be updated within one display period can be one piece, which makes it possible to provide the liquid crystal response with three times as long a display period as compared with the display period of the ordinary primary color sequential lighting system per pixel for response of the liquid crystal. Consequently, when the response of the liquid crystal has been completed, the three primary colors of light can be emitted simultaneously to obtain a display with full light and shade contrast.

In this display system, the backlight does not perform emission in the temporal region during which the liquid crystal is slow in response rate, which makes it possible to suppress the perception of occurrence of blurring of the display, or a decrease in the ratio between light and shade due to a delay in the liquid crystal response. FIG. 7 shows a block diagram of a liquid crystal display device which switches between a display according to the timing chart of the present embodiment and a display by the ordinary three primary color sequential driving. In FIG. 7, there are a black-and-white conversion circuit 8 and a switch 9 by which the black-and-white conversion of data is carried out and the timing of backlight emission is switched, thereby obtaining a display with sufficient light and shade even when the liquid crystal becomes slow in response rate.

Embodiment 4

Embodiment 3 shows the system of switching the display timings with the use of the manual switch. On the other hand, similar to Embodiment 2, a temperature sensor can be installed inside or outside the liquid crystal display device to automatically switch the display timings when low temperatures cause the liquid crystal to become slow in its response rate.

According to the present invention, the backlight emission can be switched between the three primary color sequential lighting and the three primary color concurrent or simultaneous lighting, depending on the intensity of ambient light, thereby allowing switching between color display with low intensity and black-and-white display with high intensity. As a result, black-and-white display with high intensity can be obtained even when the ambient light is bright.

The display data of the three primary colors of light are averaged depending on ambient temperatures, and the backlighting of the three primary colors of light is emitted concurrently in the latter part of the display period, thereby maintaining proper contrast as black-and-white display, even in low temperatures.

What is claimed is:

1. A liquid crystal display device for color display, comprising a transmission-type liquid crystal panel capable of controlling an amount of transmission light and a backlight, disposed behind the liquid crystal panel, capable of emitting three colors of light separately in a time-dividing manner, in which three data corresponding to the three colors of the backlight are displayed sequentially to thereby make the backlight emit a corresponding color in a period corresponding to data to be displayed, wherein switching can be performed manually or in response to an outside signal, between a sequence in which the backlight emits three colors separately one time in one display period to perform color display, and a sequence in which the backlight emits three colors simultaneously three times in one display period to perform black-and-white display.

2. A liquid crystal display device, comprising a transmission-type liquid crystal panel capable of controlling an amount of transmission light and a backlight, disposed behind the liquid crystal panel, capable of emitting three colors of light separately in a time-dividing manner, in which three data corresponding to the three colors of the backlight are displayed sequentially to thereby make the backlight emit a corresponding color in a period corresponding to data to be displayed, wherein the device includes a circuit for averaging display data of three colors, corresponding to one display content, to convert the color data into black-and-white display data and for simultaneously making display period three times as long, compared with that display period of a color display, to perform black-and-white display, and wherein three color sequential display and black-and-white display can be switched by a switch in which the backlight emits three colors separately in case of the color display while the backlight emits three colors simultaneously three times in a latter part of the display period in the case of black-and-white display.

3. The liquid crystal display device of claim 1, wherein there is enabled switching between a case in which the backlight emits three colors separately and a case in which the backlight emits three colors simultaneously, in response to signal input from an optical sensor in the device.

4. The liquid crystal display device of claim 1, wherein there is enabled switching between a case in which the backlight emits three colors separately and a case in which the backlight emits three colors simultaneously, in response to signal input from a temperature sensor in the device.

5. The liquid crystal display device of claim 1, wherein there is enabled switching between a case in which the backlight emits three colors separately and a case in which the backlight emits three colors simultaneously, in response to signal input from an optical sensor installed outside the device.

6. The liquid crystal display device of claim 1, wherein there is enabled switching between a case in which the backlight emits three colors separately and a case in which the backlight emits three colors simultaneously, in response to signal input from a temperature sensor installed outside the device.

* * * * *